United States Patent [19]

Gallusser et al.

[11] 4,262,987

[45] Apr. 21, 1981

[54] ELECTRICAL CONNECTOR

[75] Inventors: David O. Gallusser, Oneonta; Donald L. Pfendler; Herbert K. Uhlig, both of Bainbridge; David L. Frear, Binghamton; Valentine J. Hemmer, Sidney; Gary C. Toombs, New Berlin, all of N.Y.

[73] Assignee: The Bendix Corporation, Southfield, Mich.

[21] Appl. No.: 79,273

[22] Filed: Sep. 27, 1979

[51] Int. Cl.[3] ..... H01R 11/08; H01R 13/12

[52] U.S. Cl. ..... 339/258 R; 339/217 S; 339/276 T

[58] Field of Search ..... 339/256 R, 258 R, 259 R, 339/276 T, 217 S

[56] References Cited

U.S. PATENT DOCUMENTS

| | | | |
|---|---|---|---|
| 3,383,645 | 5/1968 | Milanese et al. | 339/256 R |
| 3,384,866 | 5/1968 | Nava | 339/276 T |
| 4,072,394 | 2/1978 | Waldron et al. | 339/276 T |
| 4,184,736 | 1/1980 | Spaulding | 339/276 T |

*Primary Examiner*—Neil Abrams

*Attorney, Agent, or Firm*—Richard V. Westerhoff; Charles D. Lacina; Raymond J. Eifler

[57] ABSTRACT

An electrical contact 47 includes a tubular liner 1 stamped and rolled from a sheet of an electrically conductive material with an annular connector retention recess 13 provided in the external surface thereof between a mating end and a wire receiving end. One or more sleeves 21, 27 are telescoped over the liner 1 with at least one sleeve deformed in place into the annular recess 13. One of the sleeves 21 can be axially aligned preparatory to deforming it into the recess by an internal projection 25 which engages an annular groove 19 on the liner 1. A second sleeve can be axially aligned by lancing it to the liner 1 and by prick-punching the sleeve.

10 Claims, 10 Drawing Figures

ELECTRICAL CONNECTOR

BACKGROUND OF THE INVENTION

1. Field of the Invention

This invention relates to electrical contact assemblies and especially to miniature contact assemblies of the socket and pin type used in multicontact electrical connectors.

2. Prior Art

With the increasing complexity of modern electronic systems and the trend toward miniaturization of system components, interest has been created in reducing the size of the connectors required to interconnect the wires extending between the various system modules. It has long been the practice to utilize multiwire socket and pin connectors for such purposes. In such connectors the wires interconnecting the system modules are inserted into elongated contacts and crimped in place. The contacts are then inserted in a connector where they are removably retained by a retention mechanism. Dozens of such contacts may be provided in a single connector.

A common practice is to machine each individual contact, however, this is expensive and therefore many inventors have turned to stamping and rolling the contacts from sheet material. Examples of contacts formed in this manner are disclosed in U.S. Pats. No. 3,286,223, No. 3,317,887, No. 3,721,943, No. 4,072,394 and No. 4,120,556. Many of these contacts include an inner tubular liner forming the contact with one or more sleeves coaxially mounted over the tubular liner to protect and strengthen the contact. These assemblies generally have an annular projection near their midpoint which cooperates with the retaining mechanism to removably secure the contact in a connector. Examples of arrangements for thus securing the contacts are shown in U.S. Pats. No. 4,072,394, No. 4,082,398 and No. 4,120,556. Other types of socket and pin contacts have an annular recess which cooperates with a retaining mechanism to secure the contact in a connector. These types of contacts have heretofore been machined to form the recess.

It is an object of the present invention to provide an improved electrical contact of the type having an annular retention recess which can be easily and inexpensively fabricated.

It is another object of the invention to provide such an electrical contact which can be rolled from sheet material and in which the contact sleeves can be secured to the contact liner by deforming the sleeves in place on the liner.

SUMMARY OF THE INVENTION

According to the present invention an electrical contact (47) comprises a tubular liner (1) having an annular recess (13) formed in its outer surface between a mating end and a wire receiving end for engaging the retention bushing in a connector. A sleeve (21) slides over at least a portion of the tubular liner and is deformed into the recess (13) in the liner in place to secure the sleeve to the liner (1). One sleeve (21) can extend the full length of the liner or two sleeves (21, 27) can be used with one covering the mating portion and the other covering the wire receiving portion of the liner (1). In other embodiments of the invention, a third sleeve (89) intermediate the other two may be provided. Where two or three tubes are used, the adjacent ends of two of the tubes (21, 27) may both be deformed into the annular recess (13) in the liner. In the preferred embodiment of the invention, the annular recess (13) in the liner is tapered (15) toward a shoulder (17) with the end of one tube (27) rolled against the tapered portion (15) and the other sleeve (21) rolled against the shoulder (17) such that the edge of the sleeve (21) rolled against the shoulder (17) abuts the top surface of the other sleeve (27). The sleeves (21, 27) can be deformed simultaneously in this arrangement by telescoping one sleeve (27) into the other (21) prior to rolling.

The sleeve (21) covering the mating portion of the contact liner can be positioned preparatory to deforming it in place into the annular recess (13) on the liner (1) by providing it with an internal projection (25) which engages an annular groove (19) in the liner (1). The second sleeve (27) can be similarly positioned preparatory to deforming it into the liner recess by lancing it to provide a finger (35) which extends into the liner (1) and serves as a stop for a wire inserted into the contact. This second sleeve (27) can additionally be prick-punched to axially align the sleeve on the liner.

The tubular liner (1) is formed by stamping out a preformed piece (75) from a sheet of resilient, electrically conductive material such as a beryllium copper alloy. The piece is stamped over a pair of projections which form depressions in the piece (75) transverse to the longitudinal axis thereof. When the stamped piece (75) is rolled about its longitudinal axis these depressions form the annular recess (13) and groove (19) in the exterior surface of the liner (1).

DETAILED DESCRIPTION

Figure 1:
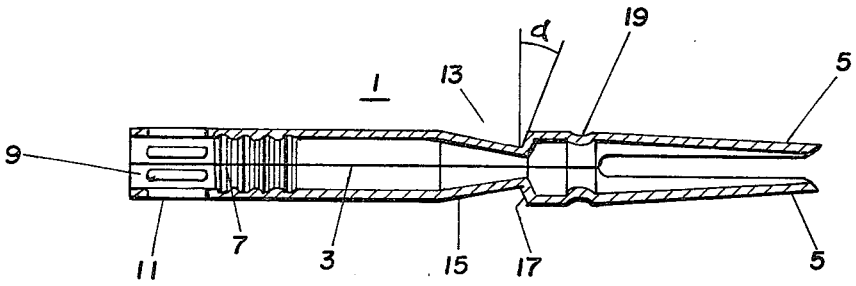
FIG. 1 is a longitudinal sectional view through a contact liner made in accordance with the teachings of the invention.

FIG. 1 illustrates a contact liner 1 which is stamped and formed from a sheet of a resilient, electrically conductive material such as a beryllium copper alloy. The liner 1, when rolled into the tubular shape shown, has a longitudinal seam 3 which is not mechanically sealed. The front or mating portion of the liner 1 has at least two spring fingers 5 which form a socket for receiving a pin type electrical contact. The rear portion of the liner is provided with a plurality of internal annular projections 7 which grip a wire inserted into the bore 9 of the liner and a plurality of longitudinal slots 11 which assure symmetrical distortion of the liner when it is crimped to electrically and mechanically secure the contact to the wire.

Intermediate the mating portion and the wire receiving portions, the liner 1 is provided with an annular recess 13. The recess 13 tapers axially toward the forward portion of the liner and radially inward as at 15 to a shoulder 17 which forms an angle $\alpha$ of approximately 15° with the plane transverse to the longitudinal axis of the liner 1. Forward of the annular recess 13 is an annular groove 19 which, as will be discussed below, is used to align parts of the contact during assembly.

Figure 2:
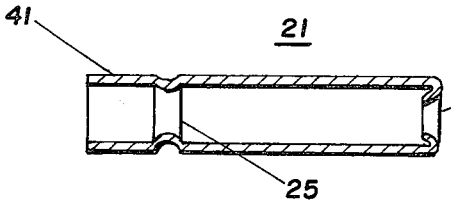
FIGS. 2 and 3 are longitudinal sectional views through contact sleeves used with the contact liner shown in FIG. 1.

FIG. 2 illustrates the configuration of a sleeve 21 having the edge at one end turned inward as at 23 to form a guide in the assembled socket contact for the pin of a mating pin type contact. The sleeve 21 is provided with an annular internal projection 25 which, as will be seen, cooperates with the annular groove 19 in the liner 1. A second sleeve 27 shown in FIG. 3 is enlarged at one end to form a cup 29 joined to the main body of the sleeve 27 by a shoulder 31 and is provided with an outwardly projecting annular stop ring 33.

Figure 3:
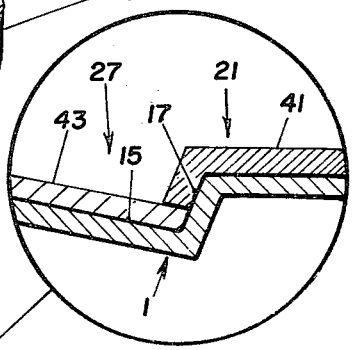
Figure 3:
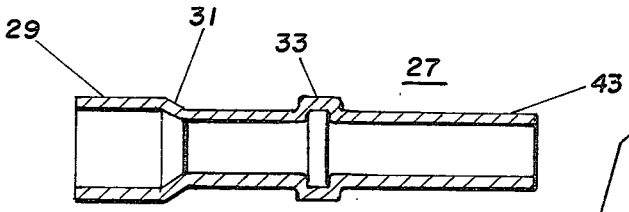
Figure 4:
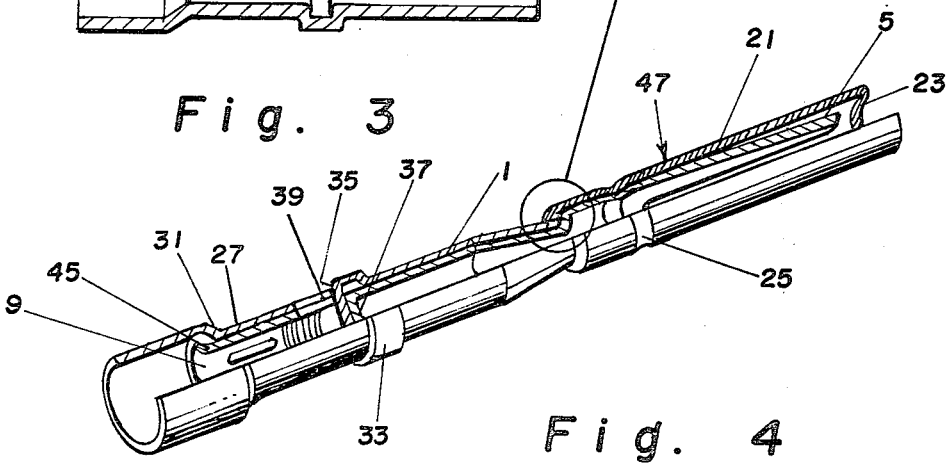
FIG. 4 is an isometric sectional view of a contact assembly incorporating the liner of FIG. 1 and the sleeves of FIGS. 2 and 3 with a portion enlarged for clarity.

FIG. 4 illustrates the liner of FIG. 1 and the sleeves of FIGS. 2 and 3 in assembled form. The sleeve 27 slides over the rear wire receiving portion of the liner 1 and is secured in place by lancing to form a finger 35 which extends into the bore 9 of the liner 1 together with a finger 37 on the liner 1. The finger 35 also serves as a stop for a wire (not shown) inserted into the bore 9 of the liner. The opening 39 produced by lancing serves as an inspection hole through which full insertion of the wire into the contact assembly can be verified. The sleeve 27 is also prick-punched to set axial alignment thereof relative to the liner.

The other sleeve 21 slides on the forward end of the liner 1 over the contact fingers 5 until the internal annular projection 25 on the sleeve engages the annular groove 19 in the liner 1. With the sleeve 21 thus axially aligned with the liner 1, the inwardly turned end 23 of the sleeve 21 serves as a guide (closed entry) for urging a pin type contact (not shown) into alignment with the socket formed by the contact fingers 5.

The ends 41 and 43 of the sleeves 21 and 27 respectively are deformed by a rolling process into the annular recess 13 in the liner 1 to permanently secure them in place. The end 43 of sleeve 27 is rolled into engagement with the tapered surface 15 of the recess 13 and the end 41 of sleeve 21 is rolled over the shoulder 17 of the liner recess so that the end thereof abuts the outer surface of the end 43 of sleeve 27 as shown in the enlarged portion of FIG. 4. Both sleeves may be rolled simultaneously by telescoping the end 43 of sleeve 27 into the end 41 of sleeve 21 prior to the rolling step. The end of liner 1 is flared as at 45 to form an abutment for the shoulder 31 of the sleeve 27 either before or after the sleeve 27 is mounted on the liner 1.

Figure 5:
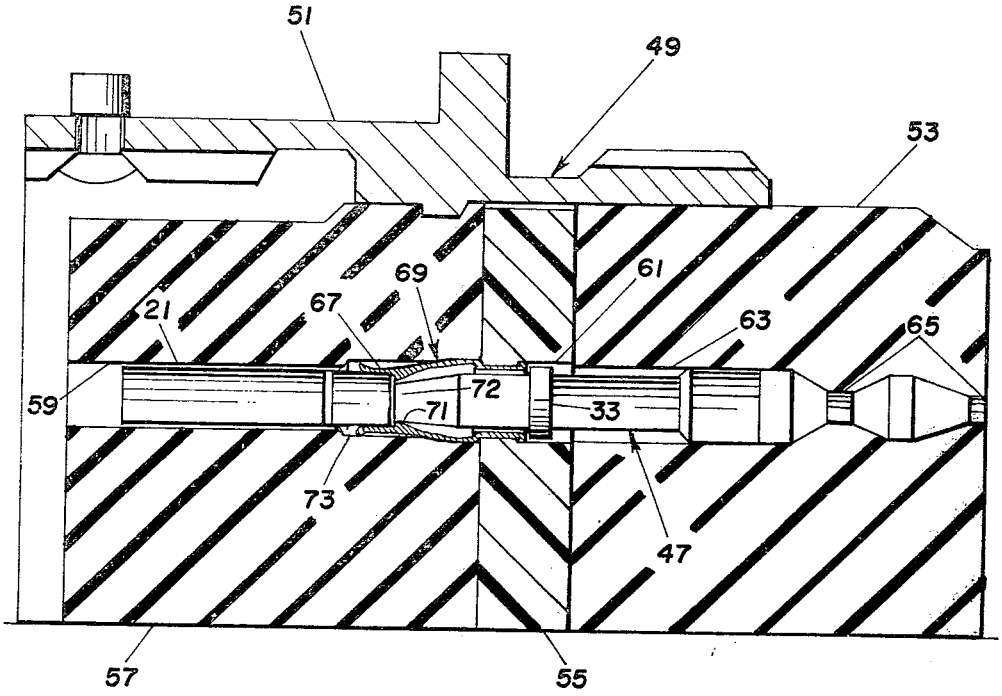
FIG. 5 is a longitudinal sectional view through a connector in which the contact assembly of FIG. 4 is retained.

The assembled contact 47 is inserted in a suitable connector such as that shown in FIG. 5. The connector 49, only a portion of which is shown, includes an annular shell 51 which houses a generally cylindrical grommet 53, a wafer 55 and a generally cylindrical insert 57, all of which are made of electrically insulating materials. The insert 57 forms the front end of the connector and the grommet 53 the rear. The insert 57 and wafer 55 are provided with bores 59 and 61 respectively therethrough which are counterbored from the rear. The grommet 53 is provided with a bore 63 with sections 65 of reduced diameter near the rear thereof.

Figure 6:
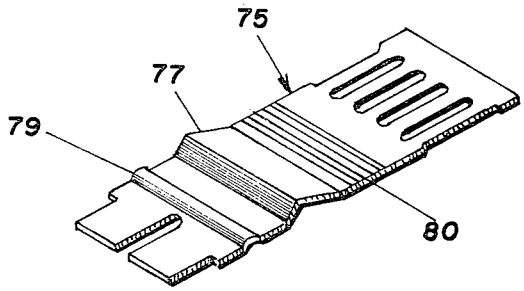
FIG. 6 is an isometric view of a stamping from which the contact liner of FIG. 1 is rolled.

The bores 59, 61 and 63 are axially aligned within the connector 49 with the resilient, longitudinal fingers 67 of an annular bushing 69 which seats against the counterbore in the wafer 55 extending into the counterbore in the insert 57. The grommet 53 is made of a resilient material so that the assembled contact 47 can be inserted into the connector 49 from the rear through the bore 63 in the grommet 53 and into the bores 61 and 59 of the wafer 55 and insert 57 respectively until the annular stop ring 33 on the contact abuts the bushing 69. As the sleeve 21 of the contact slides through the resilient fingers 67 of the bushing 69, the fingers are radially deflected until shoulders 71 on the fingers snap into engagement with the shoulder 72 on the contact to lock the contact 47 within the connector. To remove the contact 47, a tubular tool (not shown) is inserted in the bore 59 of the insert around the contact sleeve 21 until it engages lip 73 on the ends of fingers 67 to radially deflect the fingers and disengage them from the shoulder 72 on the contact so that the contact can then be pushed rearward and out through the bore 63 in the grommet 53. FIG. 6 illustrates a stamping 75 from which the tubular liner of the contact assembly is formed. A sheet of resilient, electrically conductive material such as a beryllium copper alloy is placed on a form so that when the blank is stamped ridges 77 and 79 are formed transverse to the longitudinal axis of the blank. The ridges 77 and 79 form the annular recess 13 and groove 19 respectively in the external surface of the liner when the blank is rolled into tubular form. In addition, transverse ridges 80 which form the internal projections 7 are also stamped into the sheet 75.

Figure 7:
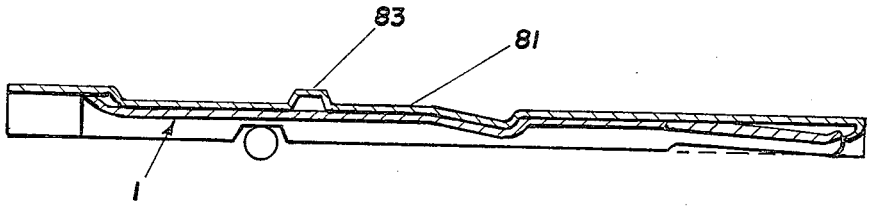
FIGS. 7 through 10 are partial longitudinal sectional views through other embodiments of the invention.
Figure 8:
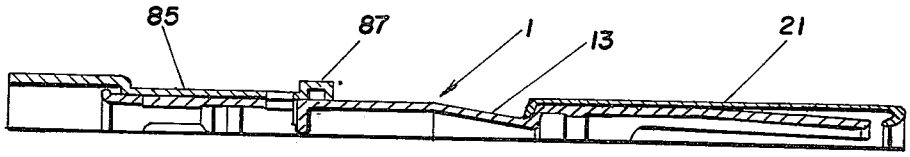
Figure 9:
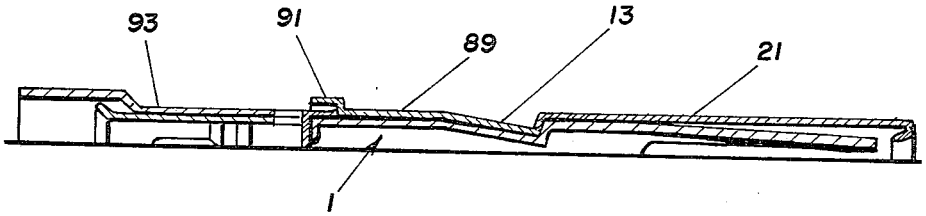
Figure 10:
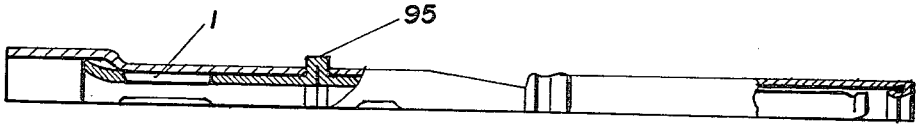

In a second embodiment of the invention illustrated in FIG. 7, one sleeve 81 extends along the entire length of the liner 1 with an integrally formed annular projection 83 serving as the stop. In another embodiment shown in FIG. 8, the sleeve 85 covering the wire receiving end of the liner 1 does not extend axially to the annular recess 13 in the liner 1 but terminates in the annular stop ring 87. In yet another embodiment of the invention, three sleeves are mounted on the liner 1 as shown in FIG. 9. In addition to the sleeve 21 covering the contact fingers, a second sleeve 89 which is rolled into the annular recess 13 extends rearward to the stop ring 91 and a third sleeve 93 covers the wire receiving ring. In this arrangement, the stop ring may be formed by either the second or third sleeves. Finally, FIG. 10 illustrates an embodiment of the invention wherein the stop ring 95 is formed on the liner 1. It should be obvious to those skilled in the art that many other variations all within the spirit of the invention could be made, and hence the particular embodiments shown are for illustrative purposes only and the invention is to be limited only by the appended claims and any and all equivalents thereof.

What is claimed is:

1. An electrical contact assembly comprising:

a tubular liner having a front mating portion, a rear wire receiving portion and a center section defining an annular bushing retention recess in the outer surface of the tubular liner between said front and rear portions, said front mating portion comprising a plurality of fingers forming a socket; and a sleeve telescopically mounted over at least one portion of the tubular liner and secured thereon by deforming said sleeve in place into the annular bushing retention recess in the tubular liner, said sleeve being axially longer than the tubular liner and with the front portion of the sleeve being turned inward and angularly rearward to form a guide for a mating pin type contact leading to said socket and with the rear portion of the sleeve extending beyond the wire receiving portion of the tubular liner and being radially enlarged to receive the insulating jacket adjacent the stripped end of a wire received in the wire receiving portion of the tubular liner.

2. The electrical contact assembly of claim 1 wherein the center section of the tubular liner also defines an annular groove on the external surface of the tubular liner and wherein the sleeve is provided with a radially inward projection which engages said groove and axially aligns the sleeve with said tubular liner preparatory to deforming said sleeve into said annular bushing retention recess.

3. An electrical contact assembly comprising:

a tubular liner forming a socket for a pin type contact at one end and a wire receiving portion at the other end, the center portion of said tubular element defining an annular recess;

a first sleeve telescopically received on the tubular liner and extending axially over at least said socket and part of said annular recess, said sleeve being deformed radially in place to extend into said annular recess to secure said sleeve on said tubular liner; and a second sleeve telescopically received on said tubular liner and extending axially from said annular recess over said wire receiving portion of the tubular liner, both of said sleeves being deformed in place to extend into said annular recesss to secure the sleeves to the tubular liner, said annular recess in the tubular liner tapering axially toward said socket and radially inward to a shoulder, said second sleeve defining an annular outwardly projecting stop between said annular recess in the tubular liner and the wire receiving portion thereof.

4. The electrical contact assembly of claim 3 wherein the second sleeve is deformed in place to grip the tapered portion of the annular recess in the tubular liner and the first sleeve is deformed in place to grip the shoulder formed by said recess with the edge of the deformed section of the first sleeve abutting the outer surface of the deformed section of the second sleeve.

5. The electrical contact assembly of claim 4 wherein said tubular liner defines an annular groove in the outer surface thereof and wherein the first sleeve is provided with an internal projection which engages said annular groove to align said first sleeve axially on the tubular liner preparatory to deforming said first sleeve into said annular recess.

6. The electrical contact assembly of claim 5 wherein the end of said tubular liner at the wire receiving portion is provided with an outward flare and wherein the end of said second sleeve adjacent thereto is provided with an enlarged portion forming a radial shoulder which engages the flared end of the tubular element.

7. An electrical contact assembly comprising:

a tubular liner having a front mating portion, a rear wire receiving portion and a center section defining an annular bushing retention recess in the outer surface of the tubular liner between said front and rear portions; and a sleeve telescopically mounted over at least one portion of the tubular liner and secured thereon by deforming said sleeve in place into the annular bushing retention recess in the tubular liner; and a second sleeve telescopically received on said tubular liner with one sleeve covering each portion of the tubular element;

the adjacent ends of each of said two sleeves deformed in place into said annular recess in the tubular element to secure them to the tubular element and with the end of one sleeve being telescopically receiving in the end of the other at the point where said sleeves are deformed into the annular recess in said tubular liner.

8. An electrical contact assembly comprising:

a tubular liner having a front mating portion, a rear wire receiving portion and a center section defining an annular bushing retention recess in the outer surface of the tubular liner between said front and rear portions, the wire receiving end of the tubular liner being provided with a radial, outwardly extending projection;

a first sleeve telescopically mounted over at least one portion of the tubular liner and secured thereon by deforming said sleeve in place into the annular bushing retention recess in the tubular liner, said first sleeve being telescopically mounted over the front mating portion of the tubular liner; and second and third sleeves telescopically received on said tubular liner in addition to the first sleeve, said second sleeve being secured on the tubular liner by deforming one end of the second sleeve in place into said annular recess in the tubular liner with the second sleeve extending along the tubular liner toward the rear wire receiving portion thereof, and said third sleeve being telescopically mounted on the tubular liner over the wire receiving portion and being provided with a radially enlarged end portion which forms a radial shoulder which bears against the radial, outwardly extending projection on the wire receiving portion of the tubular liner to secure the third sleeve between said outwardly extending projection and the second sleeve.

9. The electrical contact assembly of either claim 1 or 8 wherein said annular recess in the tubular liner tapers axially toward the mating portion of the tubular liner and radially inward to a shoulder and wherein an annular outwardly extending projection is provided on a sleeve between said annular recess and the wire receiving portion of said tubular liner.

10. The electrical contact assembly of claim 8 wherein said annular recess in the tubular liner tapers axially toward the matting portion of the tubular element and radially inward to a shoulder and wherein an annular outwardly projecting stop is provided on the tubular liner between said annular recess and the wire receiving portion of the tubular liner.

* * * * *